US005120463A

United States Patent [19]

Bjork et al.

[11] Patent Number: 5,120,463

[45] Date of Patent: Jun. 9, 1992

[54] DEGRADATION RESISTANT DETERGENT COMPOSITIONS BASED ON CELLULASE ENZYMES

[75] Inventors: Nancy S. Bjork, Burlingame; Kathleen A. Clarkson, San Francisco; Pushkaraj J. Lad, San Mateo; Geoffrey L. Weiss, San Francisco, all of Calif.

[73] Assignee: Genencor International, Inc., South San Francisco, Calif.

[21] Appl. No.: 686,265

[22] Filed: Apr. 15, 1991

Related U.S. Application Data

[63] Continuation of Ser. No. 422,814, Oct. 19, 1989, abandoned.

[51] Int. Cl.[5] ..... C11D 7/46

[52] U.S. Cl. ..... 252/174.12; 252/DIG. 12; 435/264

[58] Field of Search ..... 252/174.12, DIG. 12; 435/264

[56] References Cited

U.S. PATENT DOCUMENTS

| | | | |
|---|---|---|---|
| 3,844,890 | 10/1974 | Horikoshi et al. | 195/62 |
| 4,435,307 | 3/1984 | Barbesgaard et al. | 252/174.12 |
| 4,443,355 | 4/1984 | Murata et al. | 252/174.12 |
| 4,738,682 | 4/1988 | Boegh et al. | 8/401 |
| 4,822,516 | 4/1989 | Suzuki et al. | 252/174.12 |
| 4,945,053 | 7/1990 | Ito et al. . | |

FOREIGN PATENT DOCUMENTS

| | | |
|---|---|---|
| 0120528 | 10/1984 | European Pat. Off. . |
| 0244234 A2 | 11/1987 | European Pat. Off. . |
| 265832 | 5/1988 | European Pat. Off. . |
| 269168 | 6/1988 | European Pat. Off. . |
| 269169 | 6/1988 | European Pat. Off. . |
| 269977 | 6/1988 | European Pat. Off. . |
| 270974 | 6/1988 | European Pat. Off. . |
| 273125 | 7/1988 | European Pat. Off. . |
| 3207825A1 | 9/1982 | Fed. Rep. of Germany . |
| 62-62898 | 3/1987 | Japan . |
| 1368599 | 10/1974 | United Kingdom . |
| 2094826A | 9/1982 | United Kingdom . |
| 2095275B | 8/1985 | United Kingdom . |
| WO89/09259 | 10/1989 | World Int. Prop. O. . |

OTHER PUBLICATIONS

"Cellulases of *Trichoderma reesei*", Schülein, Methods in Enzymology (160), pp. 234–242, 1988.

Hayashida et al., "Cellulases of *Humicola insolens* and *Humicola grisea*", Methods in Enzymology, vol. 160, pp. 323–332 (1988).

Hayashida et al., (II), "Production and Purification of Thermostable Cellulases from *Humicola insolens* YH-8", *Agri. Biol. Chem.* 44(8), pp. 1721–1728 (1980).

Miller et al., "Direct and Indirect Gene Replacements in *Aspergillus nidulans*", *Mol. and Cell. Biol.*, vol. 5(7), pp. 1714–1721 (1985).

Wood et al., "Aerobic and Anaerobic Fungal Cellulases, With Special Reference to Their Mode of Attack on Crystalline Cellulose", *Biochemistry and Genetics of Cellulose Degradation*, pp. 31–52 (1988).

Brown, et al., "Genetic Control of Environmental Pollutants", Gilbert S. Ommen Editor, Chapter—Microbial Enzymes and Lingo-Cellulase Utilization (1984).

Wood, Biochem. Soc. Trans., 13, 407–410 (1985).

Shoemaker, et al., Bio-Technology, (Oct. 1983).

Henrissat, et al., Gene, 81, pp. 83–95 (1985).

Chanzy, et al., FEBS Letters, 153, pp. 113–118 (1985).

Fagerstarm, et al., FEBS Letters, 119, No. 1, pp. 97–100 (1980).

*Primary Examiner*—Prince Willis, Jr.

*Assistant Examiner*—K. Fries

*Attorney, Agent, or Firm*—Burns, Doane, Swecker and Mathis

[57] ABSTRACT

Disclosed are detergent compositions containing a combination of exo-cellobiohydrolase I type cellulase components and endoglucanase components wherein the exo-cellobiohydrolase I type cellulase components are enriched relative to the endoglucanase components. The detergent compositions of this invention provide excellent cleaning of cotton garments while also providing substantially reduced degradation of the cotton fabric in the garment.

24 Claims, No Drawings

DEGRADATION RESISTANT DETERGENT COMPOSITIONS BASED ON CELLULASE ENZYMES

This application is a continuation of application Ser. No. 07/422,814, filed Oct. 19, 1989, now abandoned.

BACKGROUND OF THE INVENTION

1. Field of the Invention

The present invention relates to detergent compositions which have improved degradation resistance to cotton fabrics. More particularly, the present invention relates to detergent compositions containing a combination of exo-cellobiohydrolase I type cellulase components and endoglucanase components wherein the exo-cellobiohydrolase I type cellulase components are enriched relative to the endoglucanse type cellulase. Such detergent compositions provide excellent cleaning especially of cotton garments while also providing substantially reduced degradation of the cotton fabric in the garment.

2. State of the Art

Cellulases are known in the art as enzymes that hydrolyze cellulose ($\beta$-1,4-glucan linkages) thereby resulting in the formation of glucose, cellobiose, cellooligosaccharide, and the like. While cellulases are produced in fungi, bacteria and the like, those produced by fungi have been given the most attention because fungi typically produce a complete cellulase system capable of degrading crystalline forms of cellulose and such cellulases can be readily produced in large quantities via fermentation procedures. In fact, as noted in "Methods in Enzymology", 160, 25, pages 234 et seq. (1988) and elsewhere, a cellulase system produced by a given microorganism is comprised of several different enzyme components including those identified as exo-cellobiohydrolases (EC 3.2.1.91) ("CBH"), endoglucanases (EC 3.2.1.4) ("EG"), $\beta$-glucosidase (EC 3.2.1.21) ("BG"). Moreover, these classes can be further separated into individual components. For example, multiple CBHs and EGs have been isolated from a variety of bacterial and fungal sources including *T. reesei* which contains 2 CBHs, i.e., CBH I and CBH II, and at least 2 EGs, i.e., EG I and EG II. The ratio of CBH I components to EG components (including all of the EG components) in naturally occurring cellulases does not exceed about 5:1. For example, see Brown et al., Genetic Control of Environmental Pollutants, Gilbert S. Omenn Editor, Chapter—"Microbial Enzymes and Ligno-Cellulase Utilization", Hollaender Publishing Corp. Variations in this ratio can result from the use of different microorganisms, depending upon the characteristics of the strain, but in any event such ratios still do not exceed about 5:1.

The complete cellulase system comprising CBH, EG and BG is required to efficiently convert crystalline cellulose to glucose. Isolated components are far less effective, if at all, in hydrolyzing crystalline cellulose. Moreover, a synergistic relationship is observed between the cellulase components. That is to say the effectiveness of the complete/whole system is significantly greater than the sum of the contributions from the isolated components. It has also been suggested by Wood, "Properties of Cellulolytic Systems", Biochem. Soc. Trans. 13, 407–410 (1985), that CBH I and CBH II derived from either *T. reesei* or *P. funiculosum* synergistically interact in solubilizing cotton fibers. On the other hand Shoemaker et al., Bio/Technology, October 1983, discloses that CBH I (derived from *T. reesei*), by itself, has the highest binding affinity but the lowest specific activity of all forms of cellulase.

The substrate specificity and mode of action of the different cellulase components varies from component to component which may account for the synergy of the combined components. For example, the current accepted mechanism of cellulase action is that endoglucanase components first break internal $\beta$-1,4-glucosidic bonds in regions of low crystallinity of the cellulose thereby creating chain ends which are recognized by CBH components. The CBH components bind preferentially to the non-reducing end of the cellulose to release cellobiose as the primary product. $\beta$-Glucosidase components act on cellooligosaccharides, e.g., cellobiose, to give glucose as the sole product.

Cellulases are also known in the art to be useful in detergent compositions either for the purpose of enhancing the cleaning ability of the composition or as a softening agent. When so used, the cellulase will degrade a portion of the cellulosic material, e.g., cotton fabric, in the wash which in one manner or another facilitates the cleaning and/or softening of the cotton fabric. While the exact cleaning mechanism of cotton fabrics by cellulase is not fully understood, the cleaning of cotton fabrics by cellulase has been attributed to its cellulolytic activity. Thus, for instance, U.S. Pat. No. 4,822,516 discloses that detergent compositions containing a cellulase having low activity on highly crystalline cellulose and high activity on low crystalline cellulose possesses good detergency and a low degree of damage on cotton garments. As noted by Wood, supra., the presence of CBH components is the distinguishing feature of cellulases that are able to degrade crystalline cellulose. Accordingly, these references would suggest that CBH components are in some form involved in the degradation of cotton fabric.

However, regardless of its cleaning and/or softening mechanism(s), the use of cellulases in detergent compositions is complicated by the fact that exposure of cotton garments to cellulase results in partial degradation of the cotton fabric in these garments. After repeated washing and drying, the integrity of the cotton garment is compromised resulting in the tearing, weakening and/or thinning of the cotton garment. When its integrity has been so compromised by repeated exposure to cellulase containing detergents, the cotton garment is no longer of any practical utility. Needless to say, such degradation greatly impairs the commercial utility of cellulases in detergent compositions. Accordingly, cellulase compositions have been sought which possess reduced cotton degradation while retaining enhanced cleaning capabilities.

Accordingly, it is an object of this invention to develop a detergent composition containing cellulase which is resistant to degrading cotton fabrics. It is a further object of this invention that such detergent compositions provide excellent cleaning of such cotton fabrics. These and other objects are achieved by the present invention as evidenced by the attached summary of the invention, detailed description of the invention and claims.

SUMMARY OF THE INVENTION

The present invention is directed to the discovery that detergent compositions containing cellulase compositions having enriched CBH I type cellulase components relative to the EG components provide excellent cleaning of cotton garments while at the same time having a reduced capability to degrade cotton fabrics. Accordingly, in its composition aspect, the present invention is directed to detergent compositions comprising at least one surface active agent and a cleaning effective amount of a cellulase composition wherein said cellulase composition contains a weight ratio of CBH I type cellulase components to EG components of greater than about 5:1. Such compositions are particularly useful as laundry detergents.

In its method aspect, the present invention is directed to a method for enhancing the degradation resistance to cotton fabric of a detergent composition containing cellulase which comprises employing a cellulase composition containing a weight ratio of CBH I type cellulase components to EG components of greater than about 5:1.

DETAILED DESCRIPTION OF THE INVENTION

As noted above, the present invention generally relates to detergent compositions containing enriched CBH I type cellulase components relative to the EG components. Such compositions possess excellent cleaning abilities while exhibiting reduced degradation potential against cotton fabrics relative to cellulase not enriched in CBH I type cellulase components. The reduced degradation potential against cotton fabrics possessed by the compositions of this invention is surprising in view of the fact that the compositions contain enriched amounts of CBH I type cellulase components. As noted above, the presence of CBH is the distinguishing feature of cellulases that are able to degrade crystalline cellulose which in turn has been implicated in the degradation of cotton fabric. Moreover, the excellent cleaning properties of the compositions of this invention are also surprising because CBH I (derived from *T. reesei*) has been shown to have the lowest specific activity of all cellulase components derived from *T. reesei* on all forms of cellulose.

However, prior to discussing this invention in detail, the following terms will first be defined.

"Cellulase" refers to the multi-enzyme system which acts on crystalline forms of cellulose and its derivatives to hydrolyze cellulose and give primary products, glucose and cellobiose. Such cellulases are synthesized by a large number of microorganisms including fungi, actinomycetes, gliding bacteria (myxobacteria) and true bacteria. Some microorganisms capable of producing cellulases useful in detergent compositions are disclosed in British Patent No. 2 094 826A, the disclosure of which is incorporated herein by reference. Most cellulases generally have their optimum activity in the acidic or neutral pH range. On the other hand, alkaline cellulases, i.e., cellulases showing optimum activity in neutral or alkaline media, are also known in the art. Microorganisms producing alkaline cellulases are disclosed in U.S. Pat. No. 4,822,516, the disclosure of which is incorporated herein by reference. Other references disclosing alkaline cellulases are EPA Publication No. 269,977 and EPA Publication No. 265,832, the disclosures of which are also incorporated herein by reference.

Cellulase produced by a microorganism is known to be comprised of several enzyme classes (components) having different substrate specificity, enzymatic action patterns, molecular weights and degree of glycosylation, isoelectric points, etc. For example and as noted above, such classes include EGs, CBHs, BGs, etc. While a specific EG produced by one microorganism will be different in primary amino acid sequence compared to EGs produced by other microorganisms, they may be classified similarly in terms of families based on sophisticated sequence comparison such as hydrophobic cluster analysis, substrate specificity, specific activity, and/or isoelectric point. Further, all EGs have similar underlying degradation properties against cellulose derivatives. See Henrissat et al., Gene, 81, pp. 83-95, (1989). Accordingly, such EGs are related by their degradation mechanisms on cellulose and in particular on soluble cellulose derivatives. By definition, all reduce the viscosity of soluble cellulose derivatives. Accordingly, the present invention does not require the use of a cellulase derived from a specific microorganism. Moreover, EGs and CBHs produced by one microorganism may or may not behave synergistically with EGs and CBHs produced by another microorganism. See Wood, supra. Accordingly, in a preferred embodiment, the EG components employed in combination with the CBH I type cellulase components in the compositions of this invention are derived from the same microorganism. However, as noted above, the specific microorganism from which these components are obtained is not critical to this invention.

Cellulase produced by a microorganism is sometimes referred to herein as a "cellulase system" to distinguish it from the classes and components of cellulase isolated therefrom.

The fermentation procedures for culturing cellulolytic microorganisms for production of cellulase are known per se in the art. For example, cellulase systems can be produced either by solid or submerged culture, including batch, fed-batch and continuous-flow processes. The collection and purification of the cellulase systems from the fermentation broth can also be effected by procedures known per se in the art.

"Endoglucanase ("EG") components" refer to all of those components of cellulase which exhibit endoglucanase type activity; that is to say that such components hydrolyze soluble cellulose derivatives such as carboxymethylcellulose (CMC), thereby reducing the viscosity of such solutions. EGs readily hydrolyze hydrated forms of cellulose such as phosphoric acid swollen cellulose or Walseth cellulose and hydrolyze less readily the more highly crystalline forms of cellulose. Such enzyme components act on internal regions of the polymer in more or less random manner resulting in a rapid decrease in polymer chain length together with a slow increase in the number of reducing ends. The rapid decrease in chain length of the cellulose polymer is evidenced by the decrease in viscosity of a cellulose solution acted upon by EG components. In particular, the viscosity of the solution is related to the molecular weight of the cellulose polymers. Accordingly, when the polymer is broken into two components, the viscosity necessarily decreases because of the decrease in molecular weight of the cellulosic polymer chain. EGs have been previously referred to as CM-cellulases or $C_x$ cellulases.

Cellulases produced by microorganisms generally contain more than one EG component with as many as six or more components possible This multiplicity is likely, in part, to be the result of artifacts in the purification methods. The different components generally have different isoelectric points which allow for their separation via ion exchange chromatography and the like. In general, combinations of EG components will give a synergistic response in activity on cellulose as compared to the single components. Accordingly, the EG components employed in this invention can be either a single EG component or a combination of two or more EG components.

"Exo-cellobiohydrolase" ("CBH") refers to those components which exhibit exo-cellobiohydrolase activity; that is to say that such components degrade cellulose by hydrolyzing cellobiose from the non-reducing end of the cellulose polymer chains. It should be noted that cellobiose is a strong competitive inhibitor for CBH ($K_i$ approximately 1 mM). CBH is further characterized by an inability to hydrolyze to any significant degree substituted celluloses, such as carboxymethylcellulose, etc. CBH, similar to EG, hydrolyzes phosphoric acid swollen cellulose or Walseth cellulose and to a lesser degree highly crystalline cellulose. CBHs have been previously referred to as $C_1$ cellulases.

CBH exhibits multiplicity and there are two CBHs from *T. reesei*, CBH I and CBH II. Accordingly, "CBH I type cellulase components" refer to those components which exhibit similar cleaning performance as that exhibited by CBH I derived from *T. reesei* when combined with EG components. Preferably, CBH I type cellulase components exhibit both similar cleaning performance and similar exo-cellobiohydrolase activity to that of CBH I derived from *T. reesei;* that is to say that such components have a strong binding affinity for cellulose fibers with no apparent preference for the non-reducing end, that is CBH I type activity binds strongly to all accessible regions of the cellulose and concomitantly has low hydrolytic activity. Depending on the enzyme concentration and conditions, such components can give up to 10% glucose as a secondary product with cellobiose being the primary product.

"CBH II type cellulase components" refer to those components which exhibit exo-cellobiohydrolase activity similar to that of CBH II derived from *T. reesei;* that is to say that such components act as true exo-cellobiohydrolase in binding and hydrolyzing cellulose from the non-reducing end of the cellulose polymer to give cellobiose as the sole product. Such components bind less strongly to cellulose and apparently only to the non-reducing ends and have a much higher hydrolytic rate as compared to CBH I type cellulase components. The rate of hydrolysis is greatly enhanced with the addition of BG which relieves inhibitory effects of cellobiose. Electron microscopic studies of CBH II (from *T. reesei*) confirm the binding and hydrolytic affinity for the non-reducing ends. See Chanzy et al., FEBS Letters, 153, pp. 113–118 (1985). It has been shown that when CBH I and CBH II are combined, such a combination exhibits synergism on crystalline cellulose (cotton) as compared to the individual components. See Fagerstarm et al., FEBS Letters, 119, No. 1, pp. 97–100 (1980). Accordingly, the cellulase composition employed in the detergent compositions of the present invention can contain CBH II type cellulase components in addition to CBH I type cellulase components and EG components. When so employed, the amount of CBH II type cellulase components is generally from about 0.001 to about 10 weight percent relative to the CBH I type cellulase component in the detergent compositions. However, in the preferred embodiment, the cellulase composition contains no CBH II type cellulase components. In fact, our results indicate that CBH II, when employed at the same concentrations as CBH I, will not demonstrate the same cleaning benefits when combined with EG components that CBH I type cellulase components do.

"$\beta$-Glucosidase (BG) components" refer to those components of cellulase which exhibit BG activity; that is to say that such components will act from the non-reducing end of cellobiose and other soluble cellooligosaccharides and give glucose as the sole product. BG components do not adsorb or react with cellulose polymers. Furthermore, such BG components are competitively inhibited by glucose ($K_i$ approximately 1 mM). While in a strict sense, BG components are not literally cellulases because they cannot degrade cellulose, such BG components are included within the definition of the cellulase system because these enzymes facilitate the overall degradation of cellulose by further degrading the inhibitory cellulose degradation products (particularly cellobiose) produced by the combined action of CBH components and EG components. Without the presence of BG components, little hydrolysis of crystalline cellulose will occur. BG components are often characterized on aryl substrates such as p-nitrophenol B-D-glucoside (PNPG) and thus are often called aryl-glucosidases. It should be noted that not all aryl glucosidases are BG components, in that some do not hydrolyze the natural substrate cellobiose.

Cellulases produced by microorganisms can contain more than one BG component. The different components generally have different isoelectric points which allow for their separation via ion exchange chromatography and the like. Because BG components degrade cellobiose which is known to inhibit the action of exo-cellobiohydrolases, such BG components can be included in the compositions of the present invention. If included, either a single BG component or a combination of BG components can be employed.

When included in the detergent composition, the BG component is generally added in an amount sufficient to prevent inhibition of the CBH and particularly, CBH I type cellulase components, by cellobiose. The amount of BG component added depends upon the amount of cellobiose produced in the detergent wash which can be readily determined by the skilled artisan. However, when employed, the weight percent of BG component relative to CBH I type cellulase components in the detergent composition is generally from about 0.2 to about 5 weight percent.

"Degradation Resistant" refers to the diminished capacity of a detergent composition containing a cellulase composition of this invention to degrade cotton fabric. In general, degradation of cotton fabric by a cellulase containing detergent is measured by the degree of thinning, weakening and/or tearing produced in the cotton fabric over a repeated number of washings with the cellulase containing detergent followed after each washing with drying in a mechanical dryer. In this regard, it appears that the use of a mechanical dryer after washing facilitates this analysis insofar as the movement of the dryer during its operation stretches and pulls the garment, which, if substantially degraded, can result in tearing of the fabric. The degradation resistance of detergent compositions containing the cellulase components as per this invention can be readily determined by measuring the degradation of identical sets of cotton clothing or cotton swatches after a repeated number of washing/drying cycles under identical conditions; one set being washed with the detergent composition of this invention, and the other being washed with a detergent composition containing a cellulase system (preferably produced from the same organism) having a ratio of CBH I type cellulase components to EG components of about 2.5:1. At the completion of at least 20 washing/drying cycles, the sets of cotton clothing are evaluated for degradation. Degradation is measured by testing the tensile strength of each garment/swatch for each set and a summation of all of the ratings for each set is then divided by the number of garments/swatches in the set so as to provide an average tensile strength. In this regard, the term "degradation resistant" means that the average tensile strength after at least 20 washing/drying cycles for the set of garments/swatches treated with the detergent composition of this invention is significantly higher than the average tensile strength of the set of garments/swatches treated with a detergent composition containing the cellulase system described above. Preferably, the detergent compositions of this invention will result in at least a ten percent (10%) increase, and more preferably a twenty percent (20%) increase, in the average tensile strength for the set of garments/swatches treated with a detergent composition of this invention as compared to the average tensile strength of the set of garments/swatches treated with a detergent composition containing the cellulase system described above.

In accordance with the present invention, detergent compositions which employ a cellulase will be rendered degradation resistant if the cellulase employed in the detergent contains a weight ratio of CBH I type cellulase components to EG components of greater than about 5:1. More preferably, the weight ratio of CBH I type cellulase components to EG components is about 10:1 or more; even more preferably about 20:1 or more and still more preferably about 40:1 or more.

It is also contemplated that the detergent compositions of this invention will also result in reduced harshness i.e., softening, of the washed garments.

Surprisingly, it has been found that it is the amount of cellulase and the ratio of CBH I type cellulase components to EG components employed in detergent compositions and not the relative rate of hydrolysis of the individual enzymatic components in producing reducing sugars from cellulose which imparts the improved cleaning of cotton garments. Even more surprisingly, is the fact that CBH II type cellulase components do not substitute for CBH I type cellulase components (at the levels tested) in providing cleaning benefits when combined with EG components in detergent compositions. Accordingly, the amount of the cellulase composition generally employed in the detergent compositions of this invention is an amount sufficient to impart improved cleaning of cotton garments. Preferably, the cellulase compositions are employed from about 0.002 weight percent to about 10 weight percent relative to the total detergent composition. More preferably, the cellulase compositions are employed from about 0.01 weight percent to about 5 weight percent relative to the total detergent composition. The cellulase composition can be added to such detergent compositions either in a liquid diluent, or as granules, or as an emulsion. Such forms are well known to the skilled artisan.

Without being limited to any theory, it is believed that the EG components and/or CBH II type cellulase components are primarily responsible for degrading cotton fabric. On the other hand, EG components are required to provide the synergistic mixture of enzymes which results in improved cleaning. However, the present invention is directed to the discovery that the desired increase in cleaning can be achieved by using a detergent composition containing only small amounts of EG component(s), i.e., less than that found in cellulases naturally produced by microorganisms. Thus, by carefully controlling the amount of EG components used in the cellulase employed in the detergent composition, one achieves a high level of cleaning while at the same time reducing the degradation potential of the composition.

Cellulase compositions having the requisite ratio of CBH I type cellulase components to EG components can be prepared by purifying the cellulase system into its components and then recombining the requisite amount of the components to achieve the desired ratio of components. In this manner, it is also possible to create cellulase compositions having little or no amounts of certain components, i.e., one can prepare a cellulase composition to be free of CBH II type cellulase components, or free of all EG components except either EG-I type cellulase components (i.e., an EG component having endoglucanase properties similar to EG-I derived from *T. reesei*) or EG-II type cellulase components (i.e., an EG component having endoglucanase properties similar to EG-II derived from *T. reesei*), or free of BG components, merely by not recombining that (those) component(s). Preferably, the cellulase compositions employed in the detergent compositions of this invention will be free of CBH II type cellulase components. In particular, CBH II type cellulase components, when employed at the same levels as CBH I, do not significantly enhance the cleaning properties of the detergent composition when enriched relative to the EG components.

The particular cellulase system employed to isolate the respective components is not critical, although certain cellulase systems may be preferred over others, i.e., an alkaline cellulase may be preferred over an acidic cellulase for use in laundry detergent compositions wherein the detergent wash solution is generally alkaline. On the other hand, an acid cellulase can be used in a pre-washing step in the appropriate solution or at an intermediate pH where sufficient activity to provide cleaning benefits still exists. Alternatively, the cellulase could be employed as a pre-soak either as a liquid or a spray, for example, as a spot remover.

Preferred cellulases for use in this invention are those obtained from *Trichoderma reesei*, *T. koningii*, Pencillum sp., and the like. Certain cellulases are commercially available, i.e., CELLUCAST (available from Novo Industry, Copenhagen, Denmark), RAPIDASE (available from Gist Brocades, N.V., Delft, Holland) and the like. Other cellulases can be readily isolated by art recognized fermentation and isolation procedures.

The cellulase system can be purified into separate components by art recognized separation techniques including ion exchange chromatography at a suitable pH, affinity chromatography, size exclusion and the like. For example, in ion exchange chromatography, it is possible to separate the cellulase components by eluting with a pH gradient, or a salt gradient, or both a pH and a salt gradient.

It is also contemplated that cellulase systems having the requisite ratio of CBH I type cellulase components to EG components could be prepared by means other than isolation and recombination of the components. However, in this regard, many attempts to modify the fermentation conditions for a natural microorganism in order to give relatively high ratios of CBH to EG components have failed likely because CBH and EG components are coordinately regulated by the microorganism. On the other hand, recombinant techniques such as gene disruption can alter the relative ratio of CBH I type cellulase component to EG components so as to produce a cellulase system having a relatively high ratio of CBH I type cellulase component to EG components.

The detergent compositions of this invention employ a surface active agent, i.e., surfactant, including anionic, non-ionic and ampholytic surfactants well known for their use in detergent compositions.

Suitable anionic surfactants for use in the detergent composition of this invention include linear or branched alkylbenzenesulfonates; alkyl or alkenyl ether sulfates having linear or branched alkyl groups or alkenyl groups; alkyl or alkenyl sulfates; olefinsulfonates; alkanesulfonates and the like. Suitable counter ions for anionic surfactants include alkali metal ions such as sodium and potassium; alkaline earth metal ions such as calcium and magnesium; ammonium ion; and alkanolamines having 1 to 3 alkanol groups of carbon number 2 or 3.

Ampholytic surfactants include quaternary ammonium salt sulfonates, betaine-type ampholytic surfactants, and the like. Such ampholytic surfactants have both the positive and negative charged groups in the same molecule.

Nonionic surfactants generally comprise polyoxyalkylene ethers, as well as higher fatty acid alkanolamides or alkylene oxide adduct thereof, fatty acid glycerine monoesters, and the like.

Suitable surfactants for use in this invention are disclosed in British Patent Application No. 2 094 826 A, the disclosure of which is incorporated herein by reference.

The surfactant is generally employed in the detergent compositions of this invention in an amount from about 1 weight percent to about 95 weight percent of the total detergent composition and preferably from about 5 weight percent to about 45 weight percent of the total detergent composition. In addition to the cellulase components and the surface active agent, the detergent compositions of this invention can additionally contain the following components:

Hydrolase except cellulase

Such hydrolases include carboxylate ester hydrolase, thioester hydrolase, phosphate monoester hydrolase, and phosphate diester hydrolase which act on the ester bond; glycoside hydrolase which acts on glycosyl compounds; an enzyme that hydrolyzes N-glycosyl compounds; thioether hydrolase which acts on the ether bond; and o-amino-acyl-peptide hydrolase, peptidyl-amino acid hydrolase, acyl-amino acid hydrolase, dipeptide hydrolase, and peptidyl-peptide hydrolase which act on the peptide bond. Preferable among them are carboxylate ester hydrolase, glycoside hydrolase, and peptidyl-peptide hydrolase. Suitable hydrolases include (1) proteases belonging to petidyl-peptide hydrolase such as pepsin, pepsin B, rennin, trypsin, chymotrypsin A, chymotrypsin B, elastase, enterokinase, cathepsin C, papain, chymopapain, ficin, thrombin, fibrinolysin, renin, subtilisin, aspergillopeptidase A, collagenase, clostridiopeptidase B, kallikrein, gastrisin, cathepsin D., bromelin, keratinase, chymotrypsin C, pepsin C, aspergillopeptidase B, urokinase, carboxypeptidase A and B, and aminopeptidase; (2) glycoside hydrolases (cellulase which is an essential ingredient is excluded from this group) α-amylase, β-amylase, gluco amylase, invertase, lysozyme, pectinase, chitinase, and dextranase. Preferably among them are α-amylase and β-amylase. They function in acid to neutral systems, but one which is obtained from bacteria exhibits high activity in an alkaline system; (3) carboxylate ester hydrolase including carboxyl esterase, lipase, pectin esterase, and chlorophyllase. Especially effective among them is lipase.

Trade names of commercial products and producers are as follows: "Alkalase", "Esperase", "Savinase", "AMG", "BAN", "Fungamill", "Sweetzyme", "Thermamyl" (Novo Industry, Copenhagen, Denmark); "Maksatase", "High-alkaline protease", "Amylase THC", "Lipase" (Gist Brocades, N.V., Delft, Holland); "Protease B-400", "Protease B-4000", "Protease AP", "Protease AP 2100" (Scheweizerische Ferment A. G., Basel, Switzerland); "CRD Protease" (Monsanto Company, St. Louis, Mo.); "Piocase" (Piopin Corporation, Monticello, Ill.); "Pronase P", "Pronase AS", "Pronase AF" (Kaken Chemical Co., Ltd., Japan); "Lapidase P-2000" (Lapidas, Secran, France); protease products (Tyler standard sieve, 100% pass 16 mesh and 100% on 150 mesh) (Clington Corn Products, Division of Standard Brands Corp., New York); "Takamine", "Bromelain 1:10", "HT Protease 200", "Enzyme L-W" (obtained from fungi, not from bacteria) (Miles Chemical Company, Elkhart, Ind.); "Rhozyme P-11 Conc.", "Pectinol", "Lipase B", "Rhozyme PF", "Rhozyme J-25" (Rohm & Haas, Genencor, South San Francisco, Calif.); "Ambrozyme 200" (Jack Wolf & Co., Ltd., Subsidiary of Nopco Chemical Company, Newark, N.J.); "ATP 40", "ATP 120", "ATP 160" (Lapidas, Secran, France); "Oripase" (Nagase & Co., Ltd., Japan).

The hydrolase other than cellulase is incorporated into the detergent composition as much as required according to the purpose. It should preferably be incorporated in an amount of 0.001 to 5 weight percent, and more preferably 0.02 to 3 weight percent, in terms of purified one. This enzyme should be used in the form of granules made of crude enzyme alone or in combination with other components in the detergent composition. Granules of crude enzyme are used in such an amount that the purified enzyme is 0.001 to 50 weight percent in the granules. The granules are used in an amount of 0.002 to 20 and preferably 0.1 to 10 weight percent.

Cationic surfactants and long-chain fatty acid salts

Such cationic surfactants and long-chain fatty acid salts include saturated or unsaturated fatty acid salts, alkyl or alkenyl ether carboxylic acid salts, α-sulfofatty acid salts or esters, amino acid-type surfactants, phosphate ester surfactants, quaternary ammonium salts including those having 3 to 4 alkyl substituents and up to 1 phenyl substituted alkyl substituents. Suitable cationic surfactants and long-chain fatty acid salts are disclosed in British Patent Application No. 2 094 826 A, the disclosure of which is incorporated herein by reference. The composition may contain from about 1 to about 20 weight percent of such cationic surfactants and long-chain fatty acid salts.

Builders

A. Divalent sequestering agents

The composition may contain from about 0 to about 50 weight percent of one or more builder components selected from the group consisting of alkali metal salts and alkanolamine salts of the following compounds: phosphates, phosphonates, phosphonocarboxylates, salts of amino acids, aminopolyacetates high molecular electrolytes, non-dissociating polymers, salts of dicarboxylic acids, and aluminosilicate salts. Suitable divalent sequestering gents are disclosed in British Patent Application No. 2 094 826 A, the disclosure of which is incorporated herein by reference.

B. Alkalis or inorganic electrolytes

The composition may contain from about 1 to about 50 weight percent, preferably from about 5 to about 30 weight percent, based on the composition of one or more alkali metal salts of the following compounds as the alkalis or inorganic electrolytes: silicates, carbonates and sulfates as well as organic alkalis such as triethanolamine, diethanolamine, monoethanolamine and trilsopropanolamine.

Antiredeposition agents

The composition may contain from about 0.1 to about 5 weight percent of one or more of the following compounds as antiredeposition agents: polyethylene glycol, polyvinyl alcohol, polyvinylpyrrolidone and carboxymethylcellulose.

Among them, a combination of carboxymethylcellulose or/and polyethylene glycol with the cellulase composition of the present invention provides for an especially useful dirt removing composition.

For removing the decomposition of carboxymethylcellulose by the cellulase in the detergent, it is desirable that carboxymethylcellulose is granulated or coated before the incorporation in the composition.

Bleaching agents

The use of the cellulase of the present invention in combination with a bleaching agent such as sodium percarbonate, sodium perborate, sodium sulfate/hydrogen peroxide adduct and sodium chloride/hydrogen peroxide adduct or/and a photo-sensitive bleaching dye such as zinc or aluminum salt of sulfonated phthalocyanine further improves the deterging effects.

Bluing agents and fluorescent dyes

Various bluing agents and fluorescent dyes may be incorporated in the composition, if necessary. Suitable bluing agents and fluorescent dyes are disclosed in British Patent Application No. 2 094 826 A, the disclosure of which is incorporated herein by reference.

Caking inhibitors

The following caking inhibitors may be incorporated in the powdery detergent:p-toluenesulfonic acid salts, xylenesulfonic acid salts, acetic acid salts, sulfosuccinic acid salts, talc, finely pulverized silica, clay, calcium silicate (such as Micro-Cell of Johns Manville Co.), calcium carbonate and magnesium oxide.

Masking agents for factors inhibiting the cellulase activity

The cellulase composition of this invention are deactivated in some cases in the presence of copper, zinc, chromium, mercury, lead, manganese or silver ions or their compounds. Various metal chelating agents and metal-precipitating agents are effective against these inhibitors. They include, for example, divalent metal ion sequestering agents as listed in the above item with reference to optional additives as well as magnesium silicate and magnesium sulfate.

Cellobiose, glucose and gluconolactone act sometimes as the inhibitors. It is preferred to avoid the co-presence of these saccharides with the cellulase as far as possible. In case the co-presence in unavoidable, it is necessary to avoid the direct contact of the saccharides with the cellulase by, for example, coating them.

Long-chain-fatty acid salts and cationic surfactants act as the inhibitors in some cases. However, the co-presence of these substances with the cellulase is allowable if the direct contact of them is prevented by some means such as tableting or coating.

The above-mentioned masking agents and methods may be employed, if necessary, in the present invention.

Cellulase-activators

The activators vary depending on variety of the cellulases. In the presence of proteins, cobalt and its salts, magnesium and its salts, and calcium and its salts, potassium and its salts, sodium and its salts or monosaccharides such as mannose and xylose, the cellulases are activated and their deterging powers are improved remarkably.

Antioxidants

The antioxidants include, for example, tert-butylhydroxytoluene, 4,4'-butylidenebis(6-tert-butyl-3methylphenol), 2,2'-butylidenebis(6-tert-butyl-4methylphenol), monostyrenated cresol, distyrenated cresol, monostyrenated phenol, distyrenated phenol and 1,1-bis(4-hydroxyphenyl)cyclohexane.

Solubilizers

The solubilizers include, for example, lower alcohols such as ethanol, benzenesulfonate salts, lower alkylbenzenesulfonate salts such as p-toluenesulfonate salts, glycols such as propylene glycol, acetylbenzenesulfonate salts, acetamides, pyridinedicarboxylic acid amides, benzoate salts and urea.

The detergent composition of the present invention can be used in a broad pH range of from acidic to alkaline pH.

Aside from the above ingredients, perfumes, preservatives, dyes and the like can be used, if desired, with the detergent compositions of this invention.

When a detergent base used in the present invention is in the form of a powder, it may be one which is prepared by any known preparation methods including a spray-drying method and a granulation method. The detergent base obtained particularly by the spray-drying method and/or spray-drying granulation method are preferred. The detergent base obtained by the spray-drying method is not restricted with respect to preparation conditions. The detergent base obtained by the spray-drying method is hollow granules which are obtained by spraying an aqueous slurry of heat-resistant ingredients, such as surface active agents and builders, into a hot space. The granules have a size of from 50 to 2000 micrometers. After the spray-drying, perfumes, enzymes, bleaching agents, inorganic alkaline builders may be added. With a highly dense, granular detergent base obtained such as by the spray-drying-granulation method, various ingredients may also be added after the preparation of the base.

When the detergent base is a liquid, it may be either a homogeneous solution or an inhomogeneous dispersion.

The following examples are offered to illustrate the present invention and should not be construed in any way as limiting the scope of this invention.

EXAMPLES

Example 1

CYTOLASE 123 cellulase, a commercially available cellulase system (from Genencor, Inc., South San Francisco, Calif.) derived from *Trichodermia reesei*, was fractionated. The normal distribution of cellulase components in this cellulase system is as follows:

| | |
|---|---|
| CBH I | 45-55 weight percent |
| CBH II | 13-15 weight percent |
| EG I | 11-13 weight percent |
| EG II | 8-10 weight percent |
| BG | 0.5-1 weight percent |

The fractionation was done using columns containing the following resins: Sephadex G-25 gel filtration resin from Sigma Chemical Company (St. Louis, Mo.), QA Trisacryl M anion exchange resin and SP Trisacryl M cation exchange resin from IBF Biotechnics (Savage, Md.). CYTOLASE 123 cellulase, 0.5g, was desalted using a column of 3 liters of Sephadex G-25 gel filtration resin with 10 mM sodium phosphate buffer at pH 6.8. The desalted solution, was then loaded onto a column of 20 ml of QA Trisacryl M anion exchange resin. The fraction bound on this column contained CBH I and EG I. These components were separated by gradient elution using an aqueous gradient containing from 0 to about 500 mM sodium chloride. The fraction not bound on this column contained CBH II and EG II. These fractions were desalted using a column of Sephadex G-25 gel filtration resin equilibrated with 10 mM sodium citrate, pH 3.3. This solution, 200 ml, was then loaded onto a column of 20 ml of SP Trisacryl M cation exchange resin. CBH II and EG II were eluted separately using an aqueous gradient containing from 0 to about 200 mM sodium chloride.

Following procedures similar to that of Example 1 above, other cellulase systems which can be separated into their components include CELLUCAST (available from Novo Industry, Copenhagen, Denmark), RAPIDASE (available from Gist Brocades, N.V., Delft, Holland), and cellulase systems derived from *T. koningii*, Penicillum so. and the like.

Example 2

Certain of the cellulase components isolated above were combined so as to provide for cellulase compositions having known ratios of CBH I components to EG components. These combinations were then employed in the swatch washing procedure set forth below. This procedure tests the ability of different cellulase detergent compositions to clean cotton swatches. In this procedure, the degree of cleaning is measured by the change (increase) in reflectance of the cotton swatches after washing as compared to its reflectance prior to washing. The larger the increase in reflectance is indicative of a cleaner swatches. Also in this procedure, other than the use of different cellulase compositions, the conditions are identical.

| | |
|---|---|
| MATERIALS: | 50 ml cap tubes<br>3 inch by 4 inch clay soiled Swatches cut in quarters (depending upon stain, use ¼ size for clay)<br>cellulase sample<br>detergent (commercially available powder or liquid detergents)<br>shakers<br>37° C. room<br>50 mM sodium citrate or 50 mM sodium acetate, pH 4.8-5.0 |
| PROCEDURE: | Gloves are worn when handling swatches in order to avoid introducing any foreign components onto the swatches.<br>Calculate ppm cellulase to add to each swatch tube<br>Label swatches, include duplicates and controls<br>Measure reflectance of each swatch<br>Load 1 swatch per tube<br>Pipet 25 mls of sodium citrate buffer per tube<br>Pipet the calculated ppm cellulase into each tube<br>Cap tubes<br>Shake each tube hard once.<br>Place tubes on shakers in 37° C. room for 30 minutes<br>Prepare a 1:20 dilution of detergent in distilled water<br>After 30 minute incubation with cellulase, add 1 ml of the 1:20 dilution of detergent to each tube<br>Shake each tube hard once<br>Place tubes back on shakers in 37° C. room for 20 minutes<br>Prepare a 1:500 dilution of detergent in distilled water<br>After incubation, rinse swatches in the tubes one time each with distilled water<br>To each tube add 25 mls of the 1:500 dilution of detergent in distilled water<br>Shake each tube hard once<br>Place tubes back on shakers in 37° C. room for 20 minutes<br>After incubation, rinse swatches in the tubes 2-3 times with distilled water. With tube partially filled with distilled water and capped, shake the tube vigorously a few times. Remove swatches from tube and rinse lightly one final time. Place swatch on paper towel and dry.<br>Measure reflectance of each swatch |

The results of this procedure are set forth in Table I below. This table indicates the increase in reflectance for detergent compositions employing the cellulase compositions having the amounts of EG II component indicated by the x-axis and the amounts of CBH I component indicated by the y-axis.

TABLE I (VALUES REPORTED ARE REFLECTANCE VALUES)

| ppm | ppm EG II | | | | |
|---|---|---|---|---|---|
| CBH-I | 0 | 10 | 30 | 100 | 500 |
| 0 | 7.75 | 15.9 | 15.95 | 19.16 | 20.45 |
| 20 | 7.5 | 27.25 | 26.45 | 31.06 | — |
| 50 | 11.95 | 33.4 | 30.65 | 30.9 | — |
| 100 | 11.85 | 37.4 | 38.15 | 39.55 | — |
| 200 | 16.4 | 51.1 | 52.8 | 49.5 | — |
| 500 | 19.25 | 56.85 | 54.4 | 62.6 | — |

The above data demonstrate that ratios of CBH I component to EG II component greater than 5:1 provide excellent cleaning of the cotton swatches at a level almost as good as ratios of CBH I component to EG II component of 5:1 or less. In fact, a 50:1 ratio of CBH I component to EG II component provides about 91 percent of the cleaning ability of a 5:1 ratio of these two cellulase components. Moreover, because the amount of EG components are reduced relative to the cellulase system, the degradation potential of the detergent composition containing this cellulase composition is reduced relative to detergent compositions containing cellulase compositions having greater amounts of EG components.

In comparison to the results set forth in Table I above, Table II below sets forth the increase in reflectance resulting from the use of a cellulase system derived from *Trichodermia reesei* in the procedure set forth above. As noted in Example 1 above, such cellulase has an approximate ratio of 2.5:1 of CBH I component to EG components (i.e., EG I plus EG II).

TABLE II

| | ppm cellulase | | | | | |
|---|---|---|---|---|---|---|
| | 0 | 50 | 100 | 200 | 500 | 1000 |
| reflt.[a] | 17.75 | 52.05 | 61.55 | 63.9 | 66.15 | 70.55 |

[a]reflt means reflectance values.

The above data shows that the detergent compositions of this invention provide excellent cleaning of cotton swatches at a level almost on par with detergent compositions containing a cellulase system. For example, the reflectance resulting from using 500 ppm CBH I component and 10 ppm EG II component in the above procedure was 56.85 (Table I) or about 86 percent of the reflectance resulting from using 500 ppm of the cellulase system. This data further shows that excellent cleaning can be obtained in spite of the fact that a sizeable portion of the EG components have been removed from the composition.

Example 3

Certain of the cellulase components isolated above were combined so as to provide for cellulase compositions having known ratios of CBH I component to EG components. These combinations were then employed in the swatch washing procedure set forth in Example 2 above. As in Example 2 above, other than the use of different cellulase compositions, the conditions are identical.

The results of this procedure are set forth in Table III below. This table indicates the increase in reflectance for cellulase compositions used in this procedure and which have the amounts of EG I and EG II components (comprised of equal amounts of EG I and EG II components) indicated by the x-axis and the amounts of CBH I component indicated by the y-axis.

TABLE III (VALUES REPORTED ARE REFLECTANCE VALUES)[b]

| ppm | ppm EG I plus EG II[c] | | | | | | | |
|---|---|---|---|---|---|---|---|---|
| CBH I | 0 | 5 | 10 | 20 | 40 | 100 | 200 | 400 |
| 0 | 25 | — | — | — | — | — | — | — |
| 10 | — | — | 17.5 | 14.7 | 20.2 | 17.3 | — | — |
| 20 | — | — | 28.4 | 25.7 | 31.1 | 30.1 | 30 | 32.75 |
| 50 | — | — | 55.4 | 56.7 | 55.7 | 50.5 | 62 | — |
| 100 | — | — | 63.3 | 68.3 | 60.1 | 51.2 | — | — |
| 200 | — | 58.1[d] 42 | 60.8 | 61.7 | 61.1 | 57.4 | — | — |
| 500 | 36.4[e] | — | 62.1 | 66.1 | 66 | 63.5 | — | — |
| 1000 | 44.8[e] | — | — | — | — | — | — | — |

[b]all reflectance values are the average of two duplicate runs: certain of the reflectance values reported herein have been rounded to the nearest tenth.
[c]500 ppm EG I and EG II without CBH O gave a reflectance value of 17.
[d]the duplicate runs for this combination of CBH I component and EG components varied so substantially that both results are reported herein.
[e]these cleaning results are possibly due to EG component impurities in the CBH I component of about 1-2 weight percent or less.

The above data together with the data taken from Example 2 demonstrates that ratios of CBH I component to EG components greater than 5:1 provide excellent cleaning of the cotton swatches at a level on par with ratios of CBH I components to EG components of 5:1 or less. For example, in Table III, a 10:1 ratio of CBH I component to EG components, i.e., 100 ppm CBH I to 10 ppm EG I plus EG II, provides about 92 percent of the cleaning ability of a 5:1 ratio of these two cellulase components, i.e., 100 ppm CBH I to 20 ppm EG I plus EG II. Likewise, a 25:1 ratio of CBH I component to EG component, i.e., 500 ppm CBH I to 20 ppm EG I plus EG II, provides substantially the same level of cleaning as a 5:1 ratio of these two cellulase components i.e., 500 ppm CBH I to 100 ppm EG I plus EG II. Moreover, because the amount of EG components are reduced relative to the cellulase system, the degradation potential of the detergent composition containing this cellulase composition is reduced relative to detergent compositions containing cellulase compositions having greater amounts of EG components.

In comparision to the results set forth in Table III above, Table IV below sets forth the increase in reflectance resulting from the use of a cellulase system derived from *Trichodermia reesei* in the procedure set forth above. As noted in Example 1 above, such cellulase has an approximate ratio of 2.5:1 of CBH I component to EG components, i.e., EG I plus EG II.

TABLE IV

| | ppm cellulase | | |
|---|---|---|---|
| | 20 | 50 | 100 |
| reflectance values | 32.5 | 42.2 | 57.7 |

The above data shows that the detergent compositions of this invention (e.g., containing an enriched fraction of CBH I type cellulase component relative to the EG components) are capable of providing a level of cleaning on par with a cellulase system in spite of the fact that a sizeable portion of the EG components have been removed from the composition.

Similarly, a CBH I type cellulase component and EG components could be substituted in place of CBH I component and EG I and II components employed in Examples II and III to provide a degradation resistant detergent composition having excellent cleaning. Such CBH I type celulase components can be obtained from *T. koningii*, Pencillum sp. and the like.

What is claimed is:

1. A detergent composition comprising at least one surface active agent and about 0.002 weight percent to about 10 weight percent relative to the total detergent composition of a cellulase composition wherein said cellulase composition contains a weight ratio of CBH I type cellulase components to EG components of about 10:1 or more.

2. The detergent composition according to claim 1 wherein said detergent composition is substantially free of CBH II type cellulase components.

3. The detergent composition according to claim 2 wherein the weight ratio of said CBH I type cellulase components to said EG components is about 10:1 or more.

4. The detergent composition according to claim 3 wherein the weight ratio of said CBH I type cellulase components to said EG components is about 40:1 or more.

5. The detergent composition according to claim 1 wherein said composition is a liquid.

6. The detergent composition according to claim 1 wherein said composition is a powder.

7. The detergent composition according to claim 1 wherein said CBH I type cellulase components and said EG components are derived from a microorganism selected from the group consisting of *Trichoderma reesei*, Penicillum sp. and *T. koningii*.

8. The detergent composition according to claim 6 wherein said CBH I type cellulase components and said EG components are derived from *Trichoderma reesei*.

9. The detergent composition according to claim 7 wherein said CBH I type cellulase components and said EG components are derived from a *Trichoderma reesei* cellulase system having the following distribution of components:

| | |
|---|---|
| CBH I | 45-55 weight percent |
| CBH II | 13-15 weight percent |
| EG I | 11-13 weight percent |
| EG II | 8-10 weight percent |
| BG | 0.5-1 weight percent |

10. The detergent composition according to claim 1 wherein said composition is a laundry detergent composition.

11. The detergent composition according to claim 1 wherein said composition is a spot remover composition.

12. The detergent composition according to claim 1 wherein said composition is a presoak composition.

13. A method for enhancing the degradation resistance to cotton fabric of a detergent composition containing cellulase which comprises:

(a) selecting a cellulase composition containing a weight ratio of CBH I type cellulase components to EG components of about 10:1 or more; and (b) adding said cellulase composition selected in (a) above to a detergent composition so as to form a degradation resistant detergent composition containing cellulase.

14. The method according to claim 12 wherein said CBH I type cellulase components are substantially free of CBH II type cellulase components.

15. The method according to claim 13 wherein the weight ratio of said CBH I type cellulase components to said EG components is about 20:1 or greater.

16. The method according to claim 14 wherein the weight ratio of said CBH I type cellulase components to said EG components is about 40:1 or more.

17. The method according to claim 12 wherein said detergent composition is a liquid.

18. The method according to claim 12 wherein said detergent composition is a powder.

19. The method according to claim 12 wherein said CBH I type cellulase components and said EG components are derived from a microorganism selected from the group consisting of *Trichoderma reesei*, Penicillum sp. and *T. koningii*.

20. The method according to claim 11 wherein said CBH I type cellulase components and said EG components are derived from *Trichoderma reesei*.

21. The method according to claim 18 wherein said CBH I type cellulase components and said EG components are derived from a *Trichoderma reesei* cellulase system having the following distribution of components:

| | |
|---|---|
| CBH I | 45-55 weight percent |
| CBH II | 13-15 weight percent |
| EG I | 11-13 weight percent |
| EG II | 8-10 weight percent |
| BG | 0.5-1 weight percent |

22. The method according to claim 12 wherein said detergent composition is a laundry detergent composition.

23. The method according to claim 12 wherein said detergent composition is a presoak detergent composition.

24. The method according to claim 12 wherein said detergent composition is a spot removing detergent composition.

* * * * *

UNITED STATES PATENT AND TRADEMARK OFFICE

CERTIFICATE OF CORRECTION

PATENT NO. : 5,120,463

DATED : June 9, 1992

INVENTOR(S) : Nancy S. Bjork et al.,

It is certified that error appears in the above-identified patent and that said Letters Patent is hereby corrected as shown below:

Column 1, line 18 where "endoglucanse" should read --endoglucanase--, and line 50, where "Chapter --" should be deleted;

Column 4, lines 34 and 39, where "per se" should read --per se--, and line 50, where "in more" should read --in a more--;

Column 8, lines 49 and 50, where "Penicillum sp." should read --Penicillium sp.--;

Column 9, line 3, where "failed likely" should read --failed, likely--, line 43, where "In addition" should begin a new paragraph, line 55, where "o-amino-acyl-peptide" should read --α-amino-acyl-peptide--, and line 67, where "D." should read --D--;

Column 10, lines 3 and 4, where "gluco amylase" should read --gluco-amylase--;

Column 11, line 9, where "gents" should read --agents--, lines 19 and 20 where "trilsopropanolamine" should read --triisopropanolamine--, line 55, where "detergent:p-toluenesulfonic" should read --detergent: p-toluenesulfonic--, and line 63, where "composition" should read --compositions--;

UNITED STATES PATENT AND TRADEMARK OFFICE

CERTIFICATE OF CORRECTION

PATENT NO. : 5,120,463

DATED : June 9, 1992

INVENTOR(S) : Nancy S. Bjork et al.

It is certified that error appears in the above-identified patent and that said Letters Patent is hereby corrected as shown below:

Column 12, line 7, where "in" should read --is--; lines 29 to 32, where "tert-butylhy-droxytoluene, 4,4'-butylidenebis(6-tert-butyl-3methyl-phenol), 2,2'-butylidenebis(6-tert-butyl-4methyl-phenol)" should read --tert-butyl-hydroxytoluene, 4,4'-butylidenebis(6-tert-butyl-3-methyl-phenol), 2,2'-butylidenebis(6-tert-butyl-4-methyl-phenol)--; and line 52, where "methods" should read --method--; and line 54, where "base" should read --bases--.

Column 13, line 52, where "Penicillum so." should read --Penicillium sp.--; line 65, where "The larger the" should read --The larger--; and line 66, where "of a cleaner" should read --of cleaner--.

Column 14, line 68, where "are" should read --is--.

Column 15, line 63, where "CBH O" should read --CBH I--.

Column 16, line 48, where "Penicillum sp." should read --Penicillium sp.--; line 63, where "10:1" should read --20:1--.

Column 17, line 9, where "Penicillum sp." should read --Penicillium sp.--; line 10, where "6" should read --7--; and line 13, where "7" should read --8--.

UNITED STATES PATENT AND TRADEMARK OFFICE

CERTIFICATE OF CORRECTION

PATENT NO. : 5,120,463

DATED : June 9, 1992

INVENTOR(S) : Nancy S. Bjork et al.,

It is certified that error appears in the above-identified patent and that said Letters Patent is hereby corrected as shown below:

Column 18, line 1, where "12" should read --13--, line 4, where "13" should read --14--, line 7, where "14" should read --15--, line 10, where "12" should read --13--, line 12, where "12" should read --13--, line 14, where "12" should read --13--, line 17 and 18, where "Penicillum sp." should read --Penicillium sp.--, line 19, where "11" should read --19--, line 22, where "18" should read --20--, line 34, where "12" should read --13--, line 37, where "12" should read --13-- and line 40, where "12" should read --13--.

Signed and Sealed this

Twenty-first Day of September, 1993

Bruce Lehman

*Attest:*

BRUCE LEHMAN

*Attesting Officer*

*Commissioner of Patents and Trademarks*